US005435510A

United States Patent [19]

Wey

[11] Patent Number: 5,435,510

[45] Date of Patent: Jul. 25, 1995

[54] DETACHABLE TABLE STAND ASSEMBLY

[76] Inventor: Louis Wey, No. 107, Wen Yuan Road, Pei Tou Cheng, Changhua Hsien, Taiwan

[21] Appl. No.: 172,268

[22] Filed: Dec. 23, 1993

[51] Int. Cl.[6] ..... F16M 11/20

[52] U.S. Cl. ..... 248/188.1; 248/163.1

[58] Field of Search ..... 248/188.1, 188, 151, 248/154, 165, 150, 163.1, 432, 440, 440.1; 108/157

[56] References Cited

U.S. PATENT DOCUMENTS

| | | | |
|---|---|---|---|
| 3,224,719 | 12/1965 | Beckman et al. | 248/188.1 X |
| 3,312,438 | 4/1967 | Goetz et al. | 248/188.1 X |
| 3,731,639 | 5/1973 | Schliemann et al. | 248/188.1 X |
| 4,632,344 | 12/1986 | Lane et al. | 248/165 |
| 4,941,413 | 7/1990 | Vanderminden | 108/157 |

*Primary Examiner*—Ramon O. Ramirez

*Attorney, Agent, or Firm*—Jones, Tullar & Cooper

[57] ABSTRACT

A detachable table stand assembly includes a plurality of stand members connected together by clamps to support a table board, wherein each stand member includes a triangular frame consisted of an upper horizontal triangle, a lower horizontal triangle, and vertical rods connected between the upper and lower horizontal triangles, a foot, and three legs having a respective top end connected to the upper horizontal triangle and a respective bottom end respectively connected to the foot; each clamp includes a casing and a shackle mounted around a respective vertical rod of two stand members and connected to the casing by locknuts.

2 Claims, 4 Drawing Sheets

DETACHABLE TABLE STAND ASSEMBLY

BACKGROUND OF THE INVENTION

The present invention relates to table stands, and more particularly to a detachable table stand assembly which can be dismantled to reduce its storage space.

Various types of table stands are known. These table stands can be grossly gathered into three types, namely, the fixed type, the folding type, and the detachable type. A fixed table stand is affixed to the table board at the bottom which cannot be detached from the table board once the table is made. Therefore, a table having a fixed table stand occupies much storage space during its delivery. A folding table stand can be collapsed to reduce the storage space when the table is not in use. A detachable table stand can be detached from the table board so that the storage space of the table can be greatly reduced. However, the folding table stand or the detachable table stand of a table is designed to fit a specific table board, and therefore it cannot be freely arranged into different forms for supporting different table boards.

SUMMARY OF THE INVENTION

The present invention has been accomplished under the aforesaid circumstances. It is therefore an object of the present invention to provide a table stand assembly which is detachable. It is another object of the present invention to provide a table stand assembly which can be conveniently arranged into any of a variety of forms for supporting any of a variety of table boards. To achieve these objects and according to one aspect of the present invention, there is provided a table stand assembly which comprises a plurality of stand members connected together by clamps to support a table board, wherein each stand member includes a triangular frame consisted of an upper horizontal triangle, a lower horizontal triangle, and vertical rods connected between the upper and lower horizontal triangles, a foot, and three legs having a respective top end connected to the upper horizontal triangle and a respective bottom end respectively connected to the foot; each clamp includes a casing and a shackle mounted around a respective vertical rod of either two stand member and connected to the casing by locknuts. According to another aspect of the present invention, a connecting open frame which consists of horizontal and vertical rods may be provided and connected horizontally between the stand members at the top to increase the supporting area of the stand assembly so that a broader table board can be supported on the stand assembly.

DETAILED DESCRIPTION OF THE PREFERRED EMBODIMENT

Figure 1:
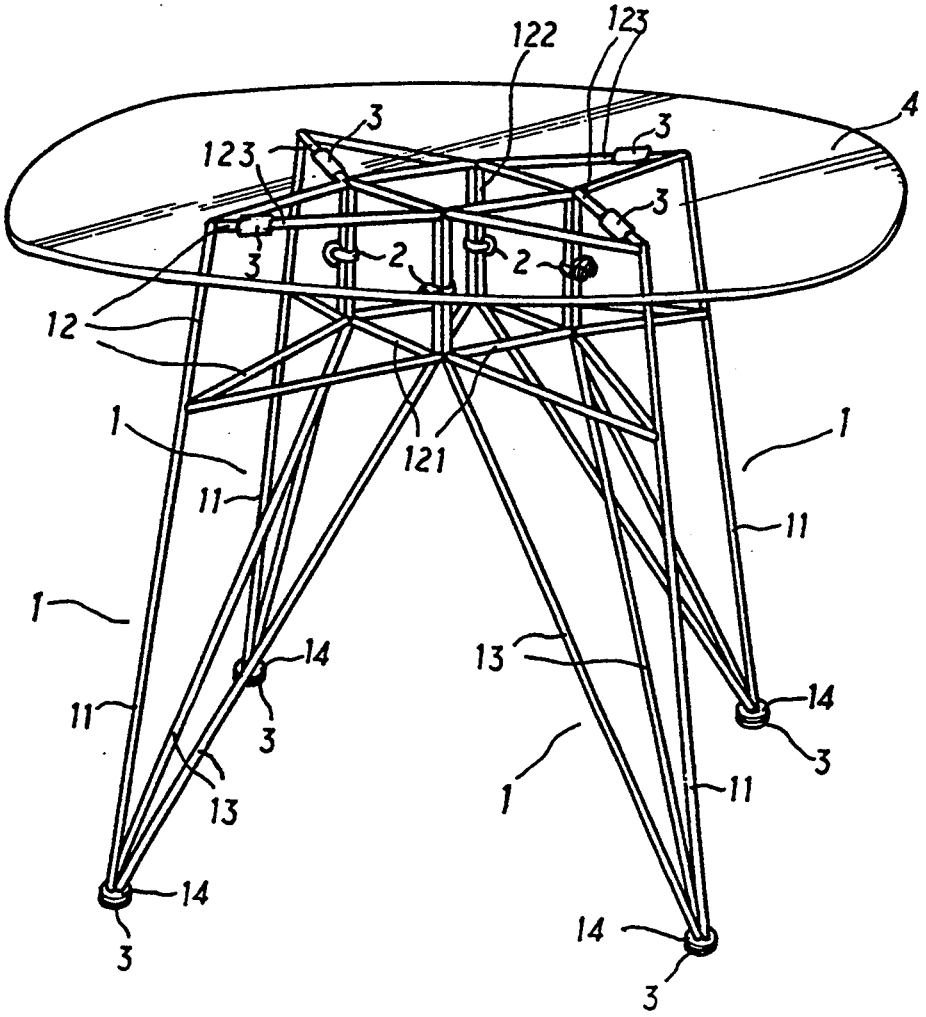
FIG. 1 is an elevational view showing an oval table board supported on a table stand assembly consisted of four stand members according to the present invention.
Figure 2:
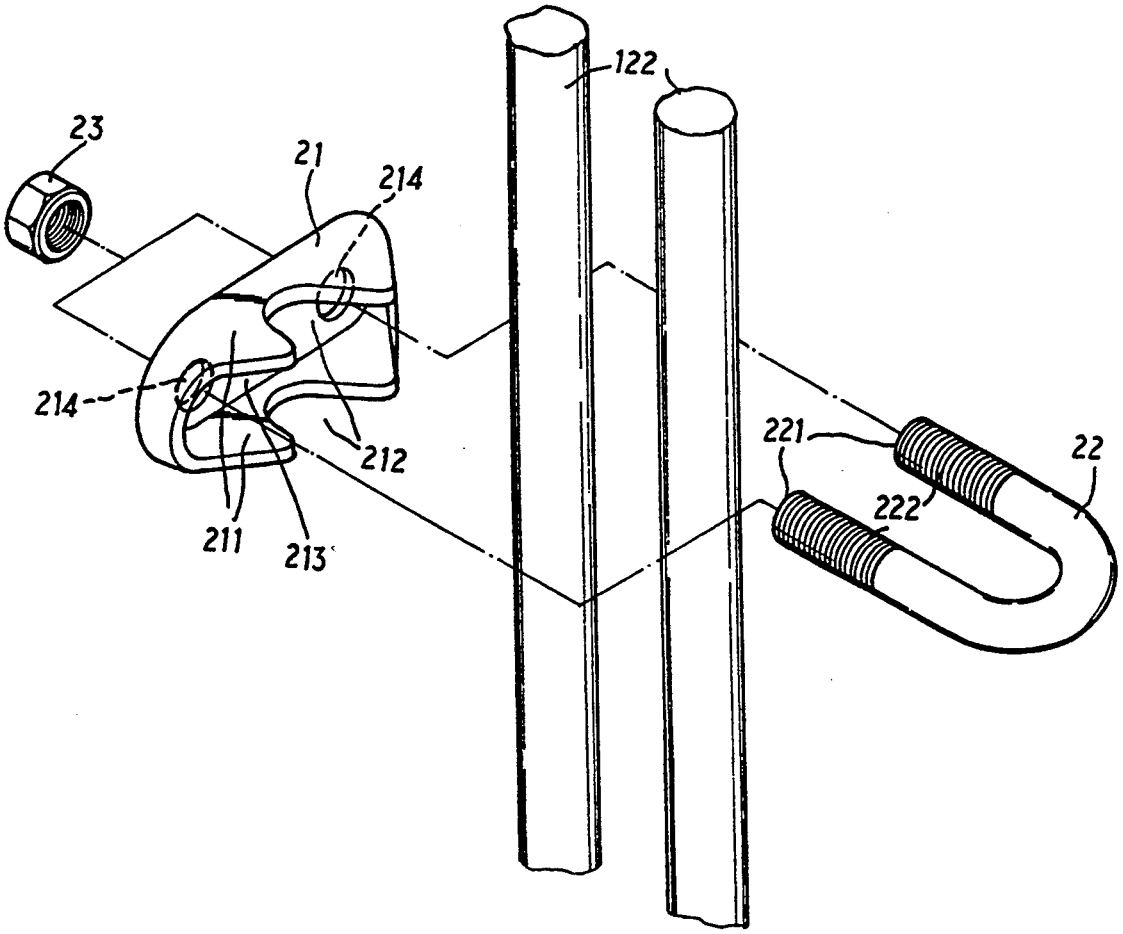
FIG. 2 is an exploded view of a clamp according to the present invention.
Figure 3:
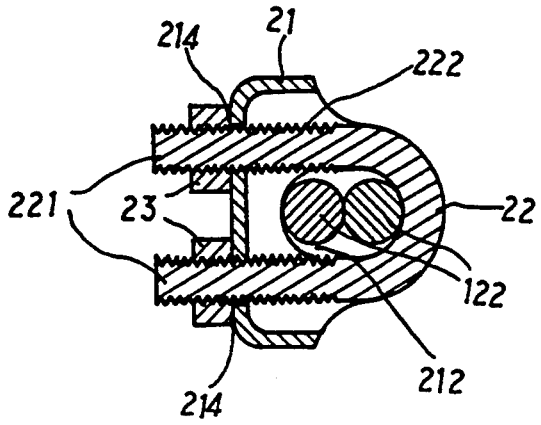
FIG. 3 is a sectional view showing the clamp of FIG. 2 installed.

Referring to FIGS. 1, 2, and 3, a table stand assembly in accordance with the present invention is generally comprised of a plurality of stand members 1 respectively made by welding metal tubes together, and a plurality of clamps 2, that respectively fasten either two stand members 1 together.

The stand member 1 comprises a three-dimensional, open, triangular frame 12 consisting of an upper horizontal triangle 123, a lower horizontal triangle 121, and vertical rods 122 connected between the upper and lower horizontal triangles 123;121, and three legs 11 each having a respective top end connected to the upper horizontal triangle 123 and a respective bottom end connected to legs 13 and then terminates, with legs 13 in a foot 14.

The clamp 2 comprises (FIG. 2) a casing 21 having two notches 212 on two opposite side walls 211 thereof, and two through holes 214 spaced on a back wall 213 thereof, a shackle 22 having outer threads 222 on two opposite ends 221 thereof, and two locknuts 23. When installed, the shackle 22 is fastened to the casing 21 to hold down either vertical rod 122 of one stand member 1 and the respective vertical rod 122 of another stand member 12by inserting the two opposite ends 221 of the shackle 22 through the through holes 214 on the casing 21 and then threading the locknuts 23 onto the outer threads 222 on the two opposite ends 221 of the shackle 22. Therefore, two stand members 1 can be conveniently and detachably fastened together by the clamp 2. Furthermore, rubber cushions 3 are respectively mounted around the upper horizontal triangle 123 and foot 14 of each stand member 1. The rubber cushions 3 on the upper horizontal triangles 123 of the stand members 1 are to support the table board 4 (See FIG. 1), and the rubber cushions 3 on the foot 14 of the stand members 1 are to support the foot 14 on the ground.

Figure 4:
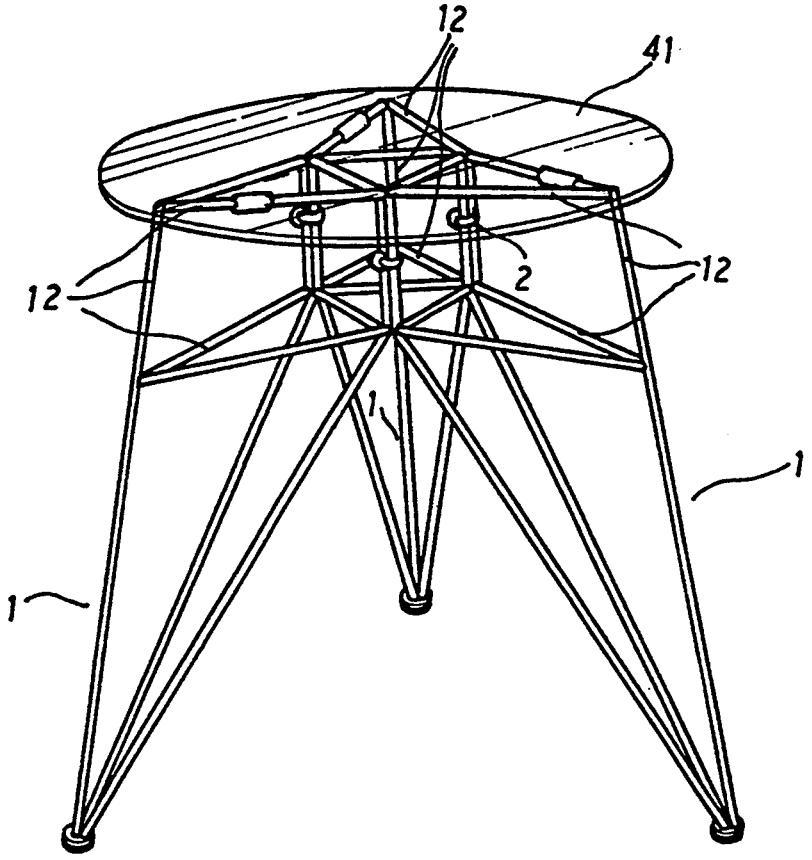
FIG. 4 shows a circular table board supported on the table stand assembly consisted of three stand members according to the present invention.

Referring to FIG. 4, there is shown an alternate arrangement of the present invention. As illustrated, the stand assembly consists of three stand members 1 connected together to support a circular table board 41.

Figure 5:
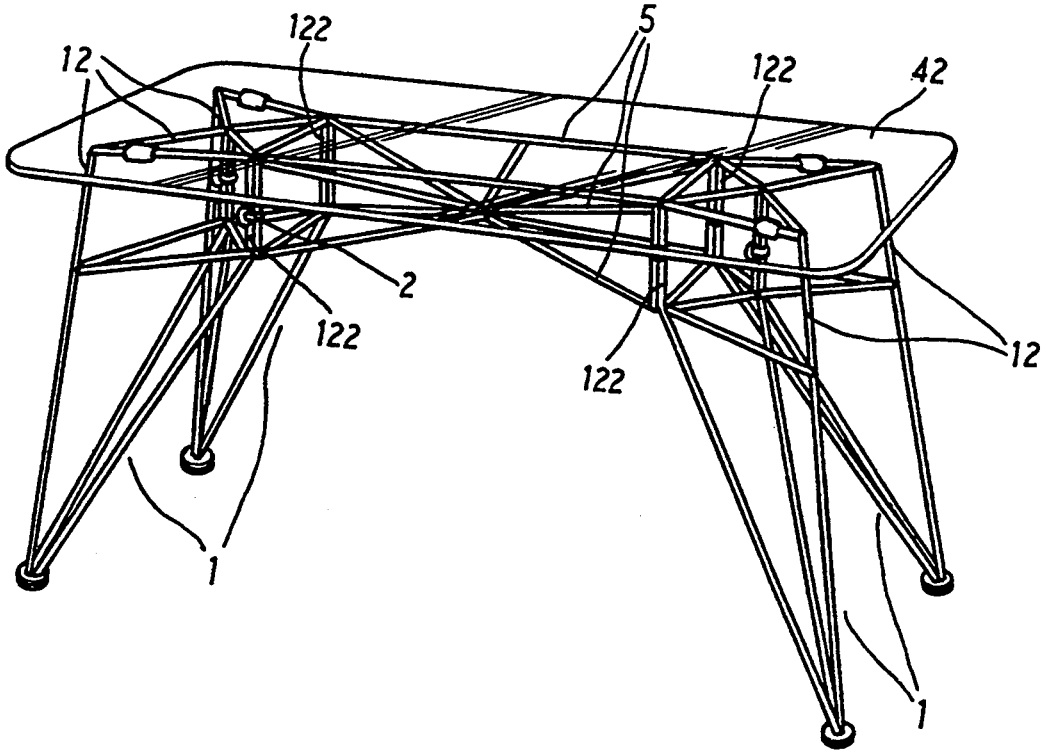
FIG. 5 shows another alternate form of the table stand assembly of the present invention installed support a rectangular table board.

Referring to FIG. 5, a plurality of stand members 1 may be symmetrically disposed at two opposite sides and connected together by a rectangular open frame 5 to support a rectangular table board 42. The rectangular open frame 5 is made by welding metal tubes together and connected to either stand member 1 by a respective clamp 2.

The clamp 2 can be unfastened by removing the locknuts 23 from the shackle 22, and therefore the stand members 1 can be detached from one another.

While it is apparent that the invention herein disclosed is well calculated to fulfill the objects above stated, it will be appreciated that various modifications and changes could be made without departing from the spirit and scope of the invention.

What is claimed is:

1. A detachable table stand assembly, comprising a plurality of stand members and a plurality of clamps to connect said stand members together, wherein each stand member comprises a triangular frame consisted of an upper horizontal triangle, a lower horizontal triangle, and vertical rods connected between said upper and lower horizontal triangles, a foot, and three legs having a respective top end connected to said upper horizontal triangle and a respective bottom end respectively connected to said foot; each clamp comprises a casing, two locknuts and a shackle connected to said casing by said locknuts to hold a respective vertical rod of two stand members together, said casing having two notches on two opposite side walls thereof at different elevation, which receives the vertical rod of one stand member, and two through holes spaced on a back wall thereof, said shackle having two threaded opposite ends respectively inserted into said through holes on said casing and screwed up with a respective locknut.

2. The detachable table stand assembly of claim 1, each triangular frame comprises a connecting open frame consisting of horizontal and vertical rods connected horizontally at the top by said clamps.

* * * * *